US010358329B2

(12) United States Patent
Ueda et al.

(10) Patent No.: US 10,358,329 B2
(45) Date of Patent: Jul. 23, 2019

(54) HYDRAULIC CONTROL DEVICE OF FORKLIFT TRUCK

(71) Applicant: KABUSHIKI KAISHA TOYOTA JIDOSHOKKI, Kariya-shi, Aichi-ken (JP)

(72) Inventors: Yuki Ueda, Aichi-ken (JP); Naoya Yokomachi, Aichi-ken (JP); Tsutomu Matsuo, Aichi-ken (JP); Takashi Uno, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 542 days.

(21) Appl. No.: 15/092,161

(22) Filed: Apr. 6, 2016

(65) Prior Publication Data

US 2016/0297656 A1 Oct. 13, 2016

(30) Foreign Application Priority Data

Apr. 10, 2015 (JP) ..... 2015-080978

(51) Int. Cl.
*B66F 9/22* (2006.01)
*F15B 11/16* (2006.01)

(52) U.S. Cl.
CPC ..... *B66F 9/22* (2013.01); *F15B 11/16* (2013.01); *F15B 2211/20515* (2013.01); *F15B 2211/465* (2013.01)

(58) Field of Classification Search
CPC ..... B66F 9/22; B66F 9/082
See application file for complete search history.

(56) References Cited

U.S. PATENT DOCUMENTS 6,389,953 B1 * 5/2002 Altman ..... B66F 9/22 414/708
9,771,250 B2 * 9/2017 Ueda ..... B66F 9/22
(Continued)

FOREIGN PATENT DOCUMENTS

EP 2799389 A1 11/2014
EP 2813461 A1 12/2014
(Continued)

OTHER PUBLICATIONS

Communication drafted Jun. 6, 2018 issued by the Japanese Patent Office in counterpart Japanese Application No. 2015-080978.
(Continued)

*Primary Examiner* — Diem M Tran
(74) *Attorney, Agent, or Firm* — Sughrue Mion, PLLC

(57) ABSTRACT

A hydraulic control device of a forklift truck includes a first hydraulic cylinder, a first instructing member, a second hydraulic cylinder, a second instructing member, a hydraulic pump, an electric motor, a first oil passage, a lowering control valve, a second oil passage that is branched from the first oil passage at a junction, a flow control valve, a first pilot passage through which pressure in the first oil passage at a position between the first hydraulic cylinder and the lowering control valve is applied to a first accommodating chamber of the flow control valve as the pressure upstream of the lowering control valve, and a second pilot passage through which pressure in the first oil passage at a position between the lowering control valve and the hydraulic pump is applied to a second accommodating chamber of the flow control valve as the pressure downstream of the lowering control valve.

4 Claims, 4 Drawing Sheets

(56) References Cited

U.S. PATENT DOCUMENTS

| | | | | |
|---|---|---|---|---|
| 2006/0191405 | A1* | 8/2006 | Itose | B66F 9/22 91/476 |
| 2014/0331662 | A1 | 11/2014 | Ueda et al. | |
| 2014/0369866 | A1 | 12/2014 | Ueda et al. | |
| 2015/0013324 | A1 | 1/2015 | Matsuo et al. | |

FOREIGN PATENT DOCUMENTS

| | | | | |
|---|---|---|---|---|
| EP | 2818446 | A1 | 12/2014 | |
| JP | 2014-097853 | A | 5/2014 | |
| WO | WO-2013099575 | A1 * | 7/2013 | B66F 9/22 |

OTHER PUBLICATIONS

Communication dated Sep. 16, 2016, from the European Patent Office in counterpart European Application No. 16163797.0.

* cited by examiner

HYDRAULIC CONTROL DEVICE OF FORKLIFT TRUCK

BACKGROUND OF THE INVENTION

The present invention relates to a hydraulic control device of a forklift truck and more specifically to a hydraulic control device to control a raising/lowering hydraulic cylinder and an operating hydraulic cylinder.

In a conventional forklift truck, a hydraulic cylinder is employed as the mechanism for operating the forks and the masts. For example, Japanese Patent Application Publication No. 2014-97853 discloses a hydraulic control device having a hydraulic pump and an electric motor driving the hydraulic pump. By driving the hydraulic pump, the lift cylinder (raising/lowering hydraulic cylinder) for operation to lift the forks and the tilt cylinder (operating hydraulic cylinder) for operation to tilt the masts are operated.

In such a forklift truck, regenerative operation may be performed by returning hydraulic oil from a lift cylinder to a hydraulic pump thanks to the weight of a load during operation to lower the forks. The above-described Publication discloses the hydraulic control device having a control valve disposed in an oil pipe connecting a bottom chamber of the lift cylinder to the hydraulic pump and a pilot type flow control valve disposed in a bypass pipe to return hydraulic oil flowed through the control valve to a tank. The hydraulic oil is discharged from the lift cylinder during operation to lower the forks is distributed to the hydraulic pump and the tank by the flow control valve.

For example, in the case of simultaneously performing operation to lower the forks and operation to tilt the masts, the opening of the flow control valve is controlled based on the pressure introduced through a pilot passage to control the flow of the hydraulic oil so that each operation is performed at the indicated speed. As a result, the tilt cylinder is driven by the hydraulic oil discharged from the hydraulic pump to tilt the masts while the hydraulic oil is discharged from the bottom chamber of the lift cylinder and the forks are lowered by the suction of the hydraulic pump.

In the case of simultaneously performing the operation to tilt the masts during the operation to lower the forks, the rotational speed of the hydraulic pump (electric motor) may be varied rapidly because sole operation is shifted to simultaneous operation. Then, the flow control valve needs to control flow of the hydraulic oil required to operate at the indicated speed corresponding to each operation. The flow control valve needs to have a quick response to the shift of the operation.

The present invention which has been made in light of the above problems is directed to providing a hydraulic control device of a forklift truck which permits to improve a response of the flow control valve.

SUMMARY OF THE INVENTION

In accordance with one aspect of the present invention, there is provided a hydraulic control device of a forklift truck including a first hydraulic cylinder that raises and lowers a fork, a first instructing member that instructs the raising and lowering movement of the fork, a second hydraulic cylinder that moves an operating member, a second instructing member that instructs the movement of the operating member, a hydraulic pump, an electric motor that is connected to the hydraulic pump, a first oil passage through which hydraulic oil discharged from the first hydraulic cylinder flows into an inlet port of the hydraulic pump during the lowering movement of the fork, a lowering control valve that is disposed in the first oil passage, wherein the lowering control valve allows flow of hydraulic oil from a bottom chamber of the first hydraulic cylinder into the hydraulic pump during the lowering movement of the fork, and blocks flow of hydraulic oil from the bottom chamber of the first hydraulic cylinder into the hydraulic pump at stop of the fork or during the raising movement of the fork, a second oil passage that is branched from the first oil passage at a junction between the hydraulic pump and the lowering control valve to flow hydraulic oil discharged from the first hydraulic cylinder to an oil tank connected to the second oil passage, a flow control valve that is disposed in the second oil passage and controls, based on pressure difference between pressure upstream of and pressure downstream of the lowering control valve, flows of hydraulic oil discharged from the first hydraulic cylinder during the lowering movement of the fork and flowing toward the hydraulic pump and the oil tank, wherein the flow control valve includes a valve element that determines an opening of the second oil passage, a first accommodating chamber that accommodates the valve element, an urging member that urges the valve element, and a second accommodating chamber that accommodates the urging member, a first pilot passage through which pressure in the first oil passage at a position between the first hydraulic cylinder and the lowering control valve is applied to the first accommodating chamber of the flow control valve as the pressure upstream of the lowering control valve, and a second pilot passage through which pressure in the first oil passage at a position between the lowering control valve and the hydraulic pump is applied to the second accommodating chamber of the flow control valve as the pressure downstream of the lowering control valve.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

First Embodiment

The following will describe a hydraulic control device of a forklift truck according to a first embodiment of the present invention with reference to FIGS. 1 through 5.

Figure 2:
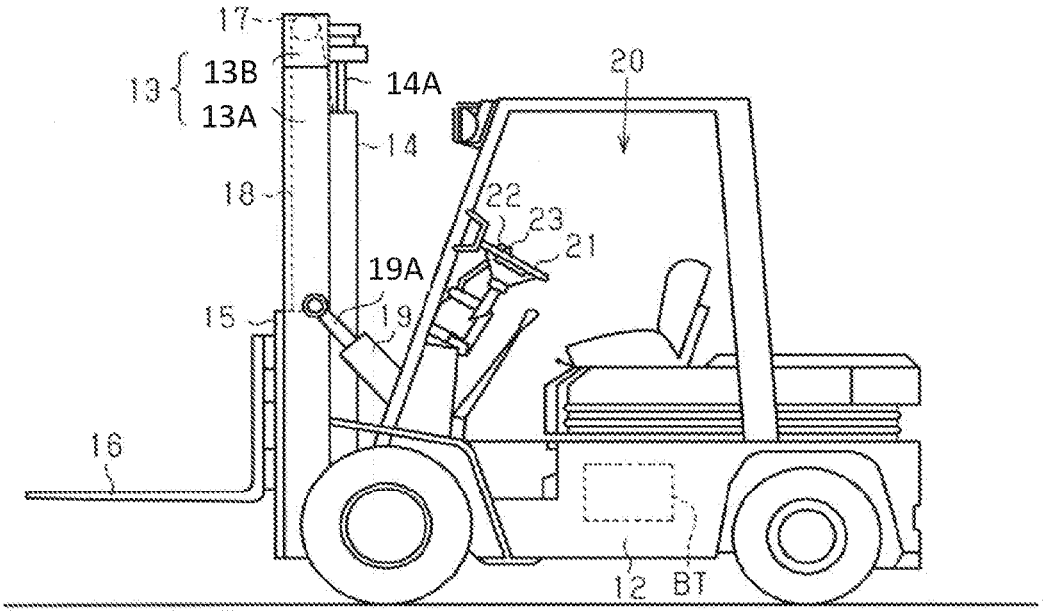
FIG. 2 is a side view of a forklift truck having the hydraulic control device of FIG. 1.

As shown in FIG. 2, the forklift truck having the hydraulic control device according to the first embodiment includes a body frame 12 and a mast assembly 13 mounted to the body frame 12 at a front part thereof. The mast assembly 13 includes a pair of right and left outer masts 13A and a pair of inner masts 13B that are provided inside and vertically movable relative to the respective outer masts 13A. A lift cylinder 14 is fixed to a rear part of each outer mast 13A, extending parallel thereto and serves as a raising/lowering hydraulic cylinder. The lift cylinder 14 has a piston rod 14A the end of which is connected to the upper part of the inner mast 13B. The lift cylinder 14 corresponds to the first hydraulic cylinder of the present invention.

A lift bracket 15 is provided vertically movable along and inside the inner masts 13B. Forks 16 serving as a loading tool (loading member) are fixed to the lift bracket 15. A chain wheel 17 is mounted to the upper part of each inner mast 13B and a chain 18 having one end thereof connected to the upper end of the lift cylinder 14 and the other end thereof to the lift bracket 15, respectively, is wound around the chain wheel 17. The forks 16 are movable vertically with the lift bracket 15 through the chains 18 by the extension and retraction of the lift cylinders 14.

Tilt cylinders 19 are pivotally supported by the body frame 12 on the opposite sides thereof and serves as an operating hydraulic cylinder. Each tilt cylinder 19 has a piston rod 19A that is pivotally connected to of the outer mast 13A substantially at a center position thereof. The mast assembly 13 is tiltable by the operation of the tilt cylinders 19. The mast assembly 13 of the present embodiment serves as the operating member of the present invention that is operated by the tilt cylinders 19. The tilt cylinder 19 corresponds to the second hydraulic cylinder of the present invention.

A steering wheel 21, a lift lever 22, and a tilt lever 23 are provided in the front part of a cabin 20. The lift lever 22 as a raising and lowering instructing member corresponds to the first instructing member of the present invention. The tilt lever 23 as an instructing member corresponds to the second instructing member of the present invention. Operation of the lift lever 22 extends or retracts the lift cylinders 14 thereby to raise or lower the forks 16. Operation of the tilt lever 23 extends or retracts the tilt cylinders 19 thereby to tilt the mast assembly 13.

With the upright position of the mast assembly 13 shown in FIG. 2 set as the center, tilting the mast assembly 13 toward the cabin 20 is backward tilting and tilting away from the cabin 20 is forward tilting, respectively. In the configuration of the forklift truck of FIG. 2, the backward tilting of the mast assembly 13 is effected by retraction of the tilt cylinders 19, while the forward tilting by extension of the tilt cylinders 19, respectively.

Figure 1:
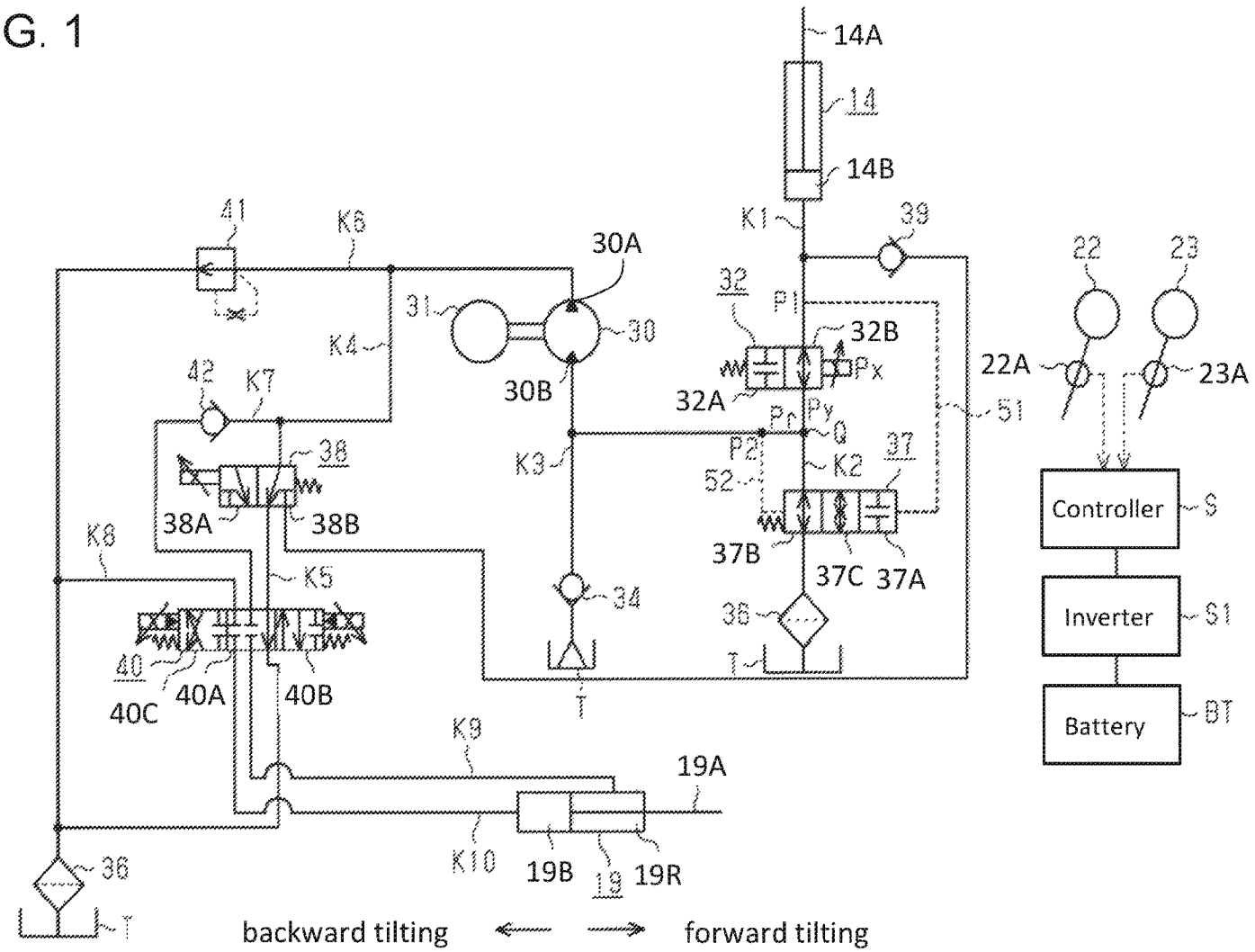
FIG. 1 is a circuit diagram of a hydraulic control device of a forklift truck according to a first embodiment of the present invention.

The following will describe the hydraulic control device according to the present embodiment reference to FIG. 1. The hydraulic control device includes a mechanism (hydraulic circuit) to control the lift cylinders 14 and the tilt cylinders 19.

There is provided a first oil passage K1 in the control device that is connected at one end thereof to the bottom chamber 14B of each lift cylinder 14 and at the other end thereof to a hydraulic pump 30 that serves as a pump and also a hydraulic motor. The hydraulic pump 30 supplies hydraulic oil to the lift cylinders 14 and the tilt cylinders 19 and functions as a hydraulic motor that is rotated by hydraulic oil discharged from the lift cylinders 14 during the lowering movement of the forks 16.

Specifically, the first oil passage K1 is connected to the inlet port 30B of the hydraulic pump 30. An electric motor 31 is connected to the hydraulic pump 30 to drive the hydraulic pump 30. The electric motor 31 drives to rotate the hydraulic pump 30 as a motor and regenerates electric power by being driven to rotate by the hydraulic pump 30 serving as a hydraulic motor. The electric motor 31 is connected to a battery BT and an inverter S1 that controls the rotational speed of the electric motor 31.

A lowering proportional control valve 32 is disposed in the first oil passage K1 for connecting the lift cylinders 14 to the hydraulic pump 30. The lowering proportional control valve 32 has a first position 32A where the hydraulic oil flowing in the first oil passage K1 is blocked and corresponds to a closed state, and a second variable-opening position 32B where the flowing of hydraulic oil from the bottom chamber 14B of the lift cylinder 14 is permitted and corresponds to an opened state. The lowering proportional control valve 32 corresponds to the lowering control valve of the present invention. The first position 32A of the lowering proportional control valve 32 blocks the flow of the hydraulic oil from the bottom chamber 14B toward the hydraulic pump 30, while the second position 32B permits the hydraulic oil from bottom chamber 14B to flow toward the hydraulic pump 30. The lowering proportional control valve 32 may be a mechanical, hydraulic or electromagnetic type valve.

A third oil passage K3 is connected at one end thereof to a point of the first oil passage K1 between the hydraulic pump 30 and the lowering proportional control valve 32 and at the other end thereof to an oil tank T. During the operation of the hydraulic pump 30 as a pump, hydraulic oil is pumped from the oil tank T and flows through the third oil passage K3. A check valve 34 is disposed in the third oil passage K3 to permit the hydraulic oil to flow only from the oil tank T toward the hydraulic pump 30.

A second oil passage K2 is connected at one end thereof to a junction Q in the first oil passage K1 at the outflow side of the lowering proportional control valve 32. The second oil passage K2 connected to the oil tank T serves as a return passage allowing the hydraulic oil discharged from the bottom chamber 14B of the lift cylinders 14 to return to the oil tank T. A flow control valve 37 is connected in the second oil passage K2 to control the flow of the hydraulic oil flowing through the second oil passage K2. The flow control valve 37 has a first fully-closed position 37A that blocks hydraulic oil, a second fully-open position 37B that allows hydraulic oil to flow therethrough, and a third variable-opening position 37C that permits hydraulic oil to flow therethrough at a controlled flow.

The flow control valve 37 operates based on the pressure difference between the pressure P1 at a point between the lowering proportional control valve 32 and the lift cylinders 14 in the first oil passage K1 (upstream side of the lowering proportional control valve 32), and the pressure P2 at a point between the junction Q in the first oil passage K1 and the hydraulic pump 30(downstream side of the lowering proportional control valve 32). Specifically, the flow control valve 37 controls the flow of the hydraulic oil that is discharged from the lift cylinders 14 during operation and flowing toward the hydraulic pump 30 and the oil tank T based on the pressure difference between the pressure P1 and the pressure P2, by taking any one of the first, the second, and the third positions 37A, 37B, 37C.

In the case of the first position 37A of the flow control valve 37, the hydraulic oil discharged from the bottom chamber 14B of the lift cylinder 14 is all flowed through the lowering proportional control valve 32 toward the hydraulic pump 30. In the case of the second position 37B of the flow control valve 37, the hydraulic oil discharged from the bottom chamber 14B of the lift cylinder 14 is all flowed through the lowering proportional control valve 32 toward the oil tank T. In the case of the third position 37C of the flow control valve 37, the hydraulic oil discharged from the bottom chamber 14B of the lift cylinders 14 is flowed through the lowering proportional control valve 32 toward the inlet port 30B of the hydraulic pump 30 and also toward the oil tank T.

A fourth oil passage K4 is connected at one end thereof to a discharge port 30A of the hydraulic pump 30 so that the hydraulic oil discharged from the hydraulic pump 30 then operating as a pump is flowed into the fourth oil passage K4. The fourth oil passage K4 is connected at the other end thereof to a junction between the lift cylinders 14 and the lowering proportional control valve 32. A raising proportional control valve 38 and a check valve 39 are connected in the fourth oil passage K4. The raising proportional control valve 38 has a first position 38A that permits variable opening of the raising proportional control valve 38 and a second position 38B that fully closes the raising proportional control valve 38. The raising proportional control valve 38 in the first position 38A allows the hydraulic oil discharged from the hydraulic pump 30 to flow through the fourth oil passage K4 toward the bottom chamber 14B of the lift cylinders 14. The raising proportional control valve 38 in the second position 38B allows the hydraulic oil discharged from the hydraulic pump 30 to flow through a fifth oil passage K5 toward a tilt proportional control valve 40. The check valve 39 allows the hydraulic oil from the raising proportional control valve 38 to flow only in the direction toward the bottom chamber 14B of the lift cylinders 14.

The fourth oil passage K4 includes a sixth oil passage K6 that is branched from the fourth oil passage K4 and connected through a filter 36 to the oil tank T and a seventh oil passage K7 that is also branched from the fourth oil passage K4 and connected to the tilt proportional control valve 40. A relief valve 41 is disposed in the sixth oil passage K6 to prevent excessive hydraulic oil pressure increase on the discharge side of the hydraulic pump 30. An eighth oil passage K8 is branched from the sixth oil passage K6 at a junction between the relief valve 41 and the filter 36 and allows the hydraulic oil from the tilt proportional control valve 40 to the oil tank T. A check valve 42 is disposed in the seventh oil passage K7 to allow the hydraulic oil to flow only in the direction from the fourth oil passage K4 toward the tilt proportional control valve 40.

The tilt proportional control valve 40 has a first position 40A that is fully closed, a second position 40B that permits the variable-opening of the tilt proportional control valve 40, and a third position 40C that also permits the variable-opening of the tilt proportional control valve 40 to change the opening as required. The tilt proportional control valve 40 in the first position 40A allows the hydraulic oil to flow from the raising proportional control valve 38 to the oil tank T. In the present embodiment, the first position 40A is a neutral position and the tilt proportional control valve 40 is shiftable from the first position 40A as the neutral position to any one of the second position 40B and the third position 40C in response to a control signal from a controller S. The tilt proportional control valve 40 in the first position 40A allows the hydraulic oil to flow from the check valve 42 to a ninth oil passage K9 that is connected to a rod chamber 19R of the tilt cylinder 19. The tilt proportional control valve 40 in the second position 40B allows the hydraulic oil to flow from a tenth oil passage K10 connected to the bottom chamber 19B of the tilt cylinders 19 to the eighth oil passage K8. The tilt proportional control valve 40 in the third position 40C allows the hydraulic oil to flow from the check valve 42 to the tenth oil passage K10 and also from the ninth oil passage K9 to the eighth oil passage K8.

The following will describe the controller S of the hydraulic control device A potentiometer 22A that detects the operation amount of the lift lever 22 and a potentiometer 23A that detects the operation amount of the tilt lever 23 are electrically connected to the controller S. The controller S controls the electric motor 31, the lowering proportional control valve 32 and the raising proportional control valve 38 based on a detected signal from the potentiometer 22A depending on operation amount of the lift lever 22. The controller S also controls the tilt proportional control valve 40 based on a detected signal from the potentiometer 23A that is representative of the operation amount of the tilt lever 23.

An inverter S1 is electrically connected to the controller S. The electric motor 31 is supplied with electric power through the inverter S1 from a battery BT. Electric power generated by the electric motor 31 is charged through the inverter S1 to the battery BT. The forklift truck according to the present embodiment is a battery powered forklift truck that travels driven by electric power charged in the battery BT.

Figure 4A:
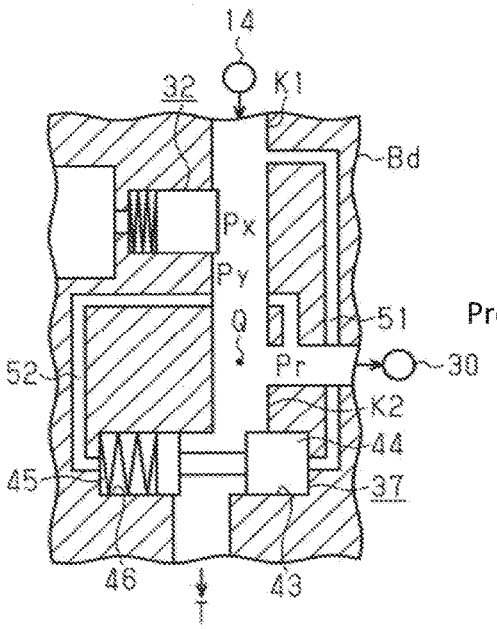
FIG. 4A is a schematic fragmentary sectional view of the hydraulic control device of FIG. 1.

The following will describe the flow control valve 37. As shown in FIG. 4A, the flow control valve 37 includes a body Bd having therein a first accommodating chamber 43. The first accommodating chamber 43 is provided with a valve element 44. The valve element 44 is movable in the first accommodating chamber 43 so that the flow sectional area (or opening) of the second oil passage K2 is adjusted according to the position of the valve element 44 in the first accommodating chamber 43. The flow control valve 37 has an urging member 45 made of a coil spring, urging the valve element 44 in the direction that increases the flow sectional area of the second oil passage K2. The body Bd of the flow control valve 37 has therein a second accommodating chamber 46 accommodating therein the urging member 45.

In the first position 37A of the flow control valve 37, the valve element 44 fully closes the second oil passage K2 against the urging force of the urging member 45. The valve element 44 of the flow control valve 37 in the second position 37B fully opens the second oil passage K2, as shown in FIG. 4A. The valve element 44 of the flow control valve 37 in the third position 37C adjustably opens the second oil passage K2 according to the pressure difference between the pressure P1 and the pressure P2.

The flow control valve 37 has therein a first pilot passage 51 and a second pilot passage 52 through which pilot pressure is introduced to the flow control valve 37. The pressure to determine the pilot pressure is applied to the first accommodating chamber 43 through the first pilot passage 51. The pressure to determine the pilot pressure is applied to the second accommodating chamber 46 through the second pilot passage 52. One end of the first pilot passage 51 is connected to the first oil passage K1 at a position between the lift cylinders 14 and the lowering proportional control valve 32. The other end of the first pilot passage 51 is connected to the first accommodating chamber 43. That is, the pressure P1 that is the pressure of the hydraulic oil discharged from the lift cylinders 14 through the first pilot passage 51 and before flowing to the lowering proportional control valve 32 is applied to the first accommodating chamber 43. Therefore, the hydraulic oil pressure present in the part of the first oil passage K1 between the lift cylinders 14 and the lowering proportional control valve 32 is applied to the first accommodating chamber 43 of the flow control valve 37 through the first pilot passage 51 as the pressure upstream of the lowering proportional control valve 32.

The second pilot passage 52 is connected at one end thereof to the first oil passage K1 at a position that is downstream of the junction Q with respect to the flowing direction of the hydraulic oil in the flow control valve 37 and at the other end thereof to the second accommodating chamber 46, so that the pressure P2 of the hydraulic oil flowing through the junction Q toward the hydraulic pump 30 is applied to the second accommodating chamber 46. Therefore, the hydraulic oil pressure present in the part of the first oil passage K1 that is downstream of the lowering proportional control valve 32 or the part of the first oil passage K1 between the lowering proportional control valve 32 and the hydraulic pump 30 through the junction Q is applied to the second accommodating chamber 46 of the flow control valve 37 through the second pilot passage 52 as the pressure downstream of the lowering proportional control valve 32. Specifically, in the present embodiment, the hydraulic oil pressure from a point in the first oil passage K1 that is downstream of the junction Q and upstream of the hydraulic pump 30 is applied to the second accommodating chamber 46 through the second pilot passage 52.

The flow control valve 37 adjusts its opening to control the flow of the hydraulic oil flowing in the second oil passage K2 in response to a pilot pressure that corresponds to the pressure difference between the upstream and the downstream of the lowering proportional control valve 32. With an increase of the flow of hydraulic oil flowing to the hydraulic pump 30 (hereinafter referred to as pump flow), the flow control valve 37 in the third position 37C thereof decreases its opening thereby to decrease the flow of the hydraulic oil returning to the oil tank T (return flow hereinafter). With a decrease of the pump flow, on the other hand, the flow control valve 37 in the third position 37C increases its opening thereby to increase the return flow to the oil tank T.

Figure 3:
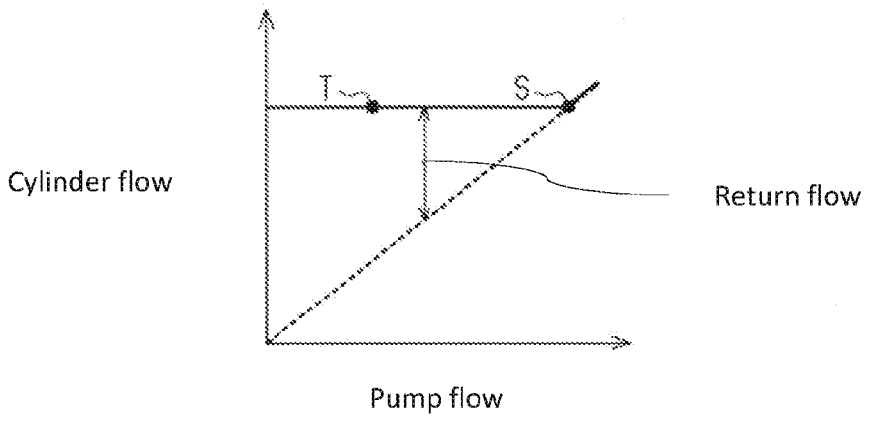
FIG. 3 is a graph showing a relation among cylinder flow, pump flow, and return flow in the hydraulic control device of FIG. 1.

FIG. 3 shows a relation between the flow of the hydraulic oil discharged from the lift cylinders 14 and the pump flow of the hydraulic oil discharged from the hydraulic pump 30 during operation of the forklift truck to lower the forks 16. The dashed line shown in FIG. 3 shows a relation between the cylinder flow and the pump flow during the operation of the forklift truck to lower the forks 16 by the lift cylinder 14 without the tilting of the mast assembly 13 by the tilt cylinders 19 (such operation being referred to as sole operation of the lift cylinders 14 or merely as sole operation).

For example, the point S in FIG. 3 indicates the state in which the forks 16 are being lowered by the sole operation of the lift cylinders 14. Then manipulating the tilt lever 23 changes the sole operation of the lift cylinders 14 to such operation being referred to as simultaneous operation of the lift cylinders 14 and the tilt cylinders 19 or merely as simultaneous operation. In the simultaneous operation of the lift cylinder 14 and the tilt cylinder 19, the rotational speed of the hydraulic pump 30 is controlled based on the operated amount of the tilt lever 23.

With the change from the sole operation to lower the forks 16 by the lift cylinders 14 to the simultaneous operation of the lift cylinders 14 to lower the forks 16 and to tilt the mast assembly 13, the rotational speed of the hydraulic pump 30 is decreased and, therefore, the pump flow is decreased and the return flow is increased. Referring to the graph of FIG. 3, the smaller the change of the cylinder flow occurring from the point S (sole operation) and to the point T (simultaneous operation) is, the smaller the variation of the operating speed of the lift cylinders 14 during the change from sole operation to the simultaneous operation is, with the result that the operation of the lift cylinders 14 is stable with very little variation of the speed. That is, as shown in solid line of FIG. 3, the variation of the cylinder flow occurring with the variation of the pump flow should desirably be as small as possible.

For this purpose, the flow control valve 37 that is controlled in response to a pilot pressure is required to have a good responsiveness to a pressure change. The use of a spring having a larger spring constant for the urging member 45 may be effective to increase the responsiveness of the flow control valve 37.

In the third position 37C of the flow control valve 37, the position of the valve element 44, or the opening of the flow control valve 37, is determined by the pressure of the first accommodating chamber 43, the urging force of the urging member 45, and the pressure of the second accommodating chamber 46. For the sake of the description, the spring constant of the urging member 45 is represented by K, the initial deflection amount of the urging member 45 in a state thereof when no pressure is applied thereto from the valve element 44 by X0, the displacement of the valve element 44 by X, and the pressure difference between the first accommodating chamber 43 and the second accommodating chamber 46 by ΔP, respectively. The pressure difference ΔP corresponds to P1−P2 (i.e. ΔP=P1−P2), where P1 is the pressure of the first accommodating chamber 43 and P2 is the pressure of the second accommodating chamber 46. S represents the pressure area of the valve element 44. The position of the valve element 44 is expressed by the following Equation (1).

$$K*(X0+X)=\Delta P*S \qquad \text{Equation (1)}$$

Figure 5A:
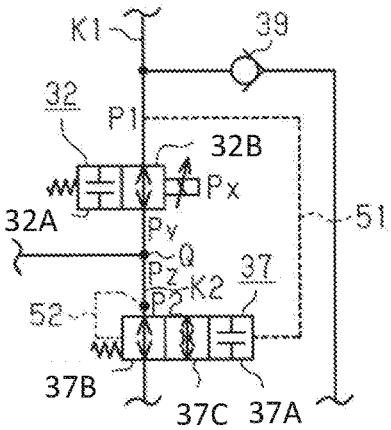
FIG. 5A is a partial circuit diagram of a hydraulic control device of a comparative example.

The following will describe a comparative example with reference to FIG. 5A. In the comparative example, one end of the second pilot passage 52 is connected to a point in the first oil passage K1 between the flow control valve 37 and the junction Q and the other end is connected to the second accommodating chamber 46. In the third position 37C of the flow control valve 37, the greater the pump flow is, the smaller the return flow is. Therefore, the pressure loss Pz that occurs in the oil passage from the junction Q to the flow control valve 37 is decreased.

Figure 5B:
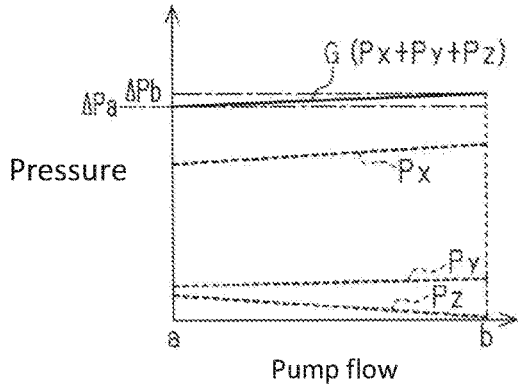
FIG. 5B is a graph showing a relation between the pump flow and the output hydraulic pressure of the hydraulic control device of FIG. 5A.

Since the second pilot passage 52 is connected at one end thereof to the second oil passage K2 at a point between the junction Q and the flow control valve 37, the pressure ΔP that determines the opening of the flow control valve 37 is determined by the pressure loss Px of the lowering proportional control valve 32, the pressure loss Py that occurs in the oil passage from the lowering proportional control valve 32 to the junction Q, and the aforementioned Pz. Specifically, the pressure ΔP that determines the opening of the flow control valve 37 is represented by the sum of the pressure losses Px, Py, and Pz or Px+Py+Pz. As shown in FIG. 5B, the pressure losses Px and Py are increased with an increase of the pump flow, but the pressure loss Pz is decreased with an increase of the pump flow and a decrease of the return flow. That is, the pressure loss Pz is in inversely proportional relation to the pump flow.

The pressure difference that occurs in the oil passage between the first and the second accommodating chambers 43, 46 and determines the opening the flow control valve 37 when the pump flow is zero and the hydraulic oil discharged from the lift cylinder 14 all returned to the oil tank T is represented by ΔPa. In this case, the valve element 44 is urged by the urging member 45 so that the flow control valve 37 is fully opened. The pressure difference that occurs between the first and the second accommodating chambers 43, 46 and determines the opening of the flow control valve 37 when the flow control valve 37 is fully closed and the hydraulic oil discharged from the lift cylinder 14 is flowed as the pump flow is represented by ΔPb. In this case, the urging member 45 is compressed so that the flow control valve 37 is fully closed.

As shown in FIG. 5B, the pressure losses Px and Py increase and the pressure loss Pz decreases with an increase of the pump flow, but the difference between the pressure differences ΔPa, ΔPb becomes very small. Substituting the pressure difference ΔPa when the pump flow is zero and the pressure difference ΔPb when the flow control valve 37 is closed in Equation (1), the spring constant K may be expressed as follows.

$$K=(\Delta Pb-\Delta Pa)/(Xb-Xa)*S \qquad \text{Equation (2)}$$

In Equation (2), Xa is the displacement of the valve element 44 when the pump flow is zero and Xb is the displacement of the valve element 44 when the hydraulic oil is flowed as the pump flow. As estimated from Equation (2), the value of ΔPb−ΔPa is very small and, therefore, the urging member 45 having a very small spring constant K is required. Spring constant K is a proportional constant that is obtained by dividing the weight on the spring by the displacement of the spring. The spring constant K of a coil spring increases with an increase of the spring wire diameter and decreases with an increase of the number of winding and the coil diameter of the coil spring. Therefore, the spring constant K of the urging member 45 may be decreased by increasing the coil diameter and/or the number of winding thereof.

The following will discuss the initial deflection amount X0 of the urging member 45. Equation (3) is introduced from Equations (1) and (2) as shown below.

$$X0=\Delta Pa*(Xb-Xa)/(Pb-\Delta Pa)-Xa \qquad \text{Equation (3)}$$

Since the value of ΔPb−ΔPa is very small, the initial deflection amount X0 of the urging member 45 needs to be large. Therefore, for the hydraulic control device of the comparative example to have a small variation of the cylinder flow during the change from sole operation to simultaneous operation as shown in FIG. 3, the initial deflection amount X0 of the urging member 45 needs to be large and the spring constant K of the urging member 45 needs to be very small. In such a case, the urging member 45 needs to be made larger in size, which leads to enlargement of the flow control valve 37.

In the present embodiment, one end of the second pilot passage 52 is connected to a point in the first oil passage K1 between the junction Q and the hydraulic pump 30, as shown in FIG. 4A. Such configuration permits to eliminate the pressure Pz from the pressure difference ΔP that determines the opening of the flow control valve 37.

Figure 4B:
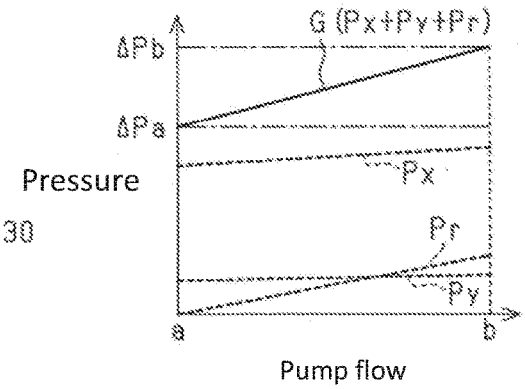
FIG. 4B is a graph showing a relation between the pump flow and the output hydraulic pressure in the hydraulic control device of FIG. 1.

As shown in FIG. 4B, the pressure loss Pr that increases with an increase of the pump flow is also added to the pressure ΔP, thus the pressure ΔP being Px+Py+Pr. Accordingly, the value of ΔPb−ΔPa that is the pressure difference between when the pump flow is zero and when the hydraulic oil discharged from the lift cylinder 14 is all flowed to the hydraulic pump 30 can be greater than that of the comparative example. From Equations (2) and (3), the spring constant K of the urging member 45 can be greater and the initial deflection amount X0 smaller. That is, a coil spring having a large spring constant K may be used as the urging member 45 and, therefore, the coil diameter of the coil spring may be decreased and the number of the winding decreased, so that the urging member 45 may be made smaller in size.

In the above-described hydraulic control device of the present embodiment, the relation between the cylinder flow and the pump flow during the operation of the forklift truck in which the forks 16 are being lowered without tilting of the mast assembly 13 corresponds to the point S in FIG. 3, where the return flow is zero and the cylinder flow is the same as the pump flow. When the operation of the forklift truck is changed from sole operation to the simultaneous operation, that is, when operation is performed to tilt the mast assembly 13 during operation lowering the forks 16, the controller S shifts the flow control valve 37 to its third position 37C to adjust the flow of hydraulic oil flowing to the hydraulic pump 30. Then, return flow occurs and the point S shifts to the point T in FIG. 3. In this case, the pressure ΔP that determines the opening of the flow control valve 37 is not influenced by the pressure loss Pz and, because the pressure ΔP has the pressure loss Pr added thereto, the difference between the pressure difference ΔPa when the pump flow is zero and the pressure difference ΔPb when the cylinder flow is the same as the pump flow is increased. Thus, an urging member 45 having a greater spring constant K and a small initial deflection amount X0 may be used as the urging member 45, with the result that the flow control valve 37 may be operated rapidly.

The following will describe the operation of the hydraulic control device according to the first embodiment. Specifically, forward or backward tilting operation of the mast assembly 13 during the operation to lower the forks 16 will be described.

The following will describe the operation to lower forks 16. Responding to a command signal from the lift lever 22, the controller S lowers the forks 16 unless the tilt lever 23 is operated. In this case, the controller S calculates the required rotational speed of the hydraulic pump 30 as the instruction speed and also the opening of the lowering proportional control valve 32 that are required for the forks 16 to be lowered at a speed in accordance with the operation amount of the lift lever 22. The controller S causes the electric motor 31 to be drive to rotate at the calculated speed and shifts the lowering proportional control valve 32 to its second position 32B based on the calculated opening. Simultaneously, the controller S shifts the raising proportional control valve 38 to its second position 38B and the tilt proportional control valve 40 to its first position 40A. The flow control valve 37 is shifted to its first position 37A by the pressure difference ΔP.

When the lowering proportional control valve 32 is opened in the second position 32B, the hydraulic oil discharged from the bottom chamber 14B of the lift cylinder 14 is flowed through the first oil passage K1 and the lowering proportional control valve 32 into the hydraulic pump 30 through its inlet port 30B. Then, in the case that the hydraulic pump 30 is operated at the instruction rotational speed by the force of the hydraulic oil discharged from the bottom chamber 14B, the electric motor 31 is driven to rotate to regenerate electric power. The electric power thus regenerated by the electric motor 31 is charged in the battery BT through the inverter S1.

The flow control valve 37 is opened to a desired opening in accordance with the pressure difference ΔP between the pressures P1, P2. Then, the hydraulic oil is flowed through the first oil passage K1 toward the hydraulic pump 30. If forward or backward tilting operation of the mast assembly 13 is performed during operation to lower the forks, the controller S calculates the rotational speed of the hydraulic pump 30 as the instruction speed and also the opening of the lowering proportional control valve 32 that are required for the forks 16 to be lowered at a speed in accordance with operation amount of the lift lever 22. The controller S calculates the required rotational speed of the hydraulic pump 30 and the opening of the tilt proportional control valve 40 that are required for the mast assembly 13 to be tilted forward or backward at an instruction speed in accordance with operation amount of the tilt lever 23.

The controller S takes the required rotational speed of the hydraulic pump 30 as the instruction rotational speed of the electric motor 31. In accordance with the above calculated valve opening, the controller S shifts the lowering proportional control valve 32 to the second position 32B and the tilt proportional control valve 40 to the second position 40B for backward tilting operation or the third position 40C for forward tilting operation. The controller S shifts the raising proportional control valve 38 to the second position 38B.

Then, the flow control valve 37 is shifted to the third position 37C in accordance with the pressure difference ΔP. In this third position 37C of the flow control valve 37, the hydraulic oil discharged from the bottom chamber 14B of the lift cylinder 14 is flowed toward the hydraulic pump 30 and also toward the oil tank T. As a result, the hydraulic oil discharged from the bottom chamber 14B is flowed through the flow control valve 37 into the oil tank T or toward a return passage and also flowed into the hydraulic pump 30 through its inlet port 30B and then discharged out therefrom through the discharge port 30A. Then, the hydraulic oil is flowed through the fourth oil passage K4 and the check valve 42 to the tilt proportional control valve 40, from where the hydraulic oil is supplied through the ninth oil passage K9 to the rod chamber 19R of the tilt cylinder 19 or through the tenth oil passage K10 to the bottom chamber 19B. Thus, the mast assembly 13 is tilted forward or backward at an instruction speed in accordance with the operation amount of the tilt lever 23.

The hydraulic control device according to the first embodiment offers the following advantageous effects.

(1) In the hydraulic control device according to the above-described embodiment wherein one of the pilot pressures is applied to the second accommodating chamber 46 of the flow control valve 37 from a point between the junction Q in the first oil passage K1 and the hydraulic pump 30, the pressure difference ΔP that determines the opening of the flow control valve 37 is not influenced by the pressure loss Pz that occurs in the oil passage from the junction Q to the flow control valve 37. As a result, the spring constant of the urging member 45 in the flow control valve 37 may be set large and the initial deflection amount X0 small. Accordingly, the responsiveness of the valve element 44 to the pilot pressure may be improved as compared to a case that uses an urging member having a smaller spring constant K and a greater initial deflection amount X0. Therefore, the valve element 44 of the flow control valve 37 can be shifted rapidly in quick response to the pilot pressure during the change from sole operation to simultaneous operation when the mast assembly 13 is tilted while the forks 16 are being lowered.

As compared to a structure in which the pilot pressure is applied to the second accommodating chamber 46 of the flow control valve 37 from a point between the junction Q and the flow control valve 37, an urging member having a greater spring constant K may be used for the urging member 45 and, therefore, the number of the winding of the urging member 45 is reduced, with the result that the urging member 45 can be made smaller in size.

(2) In the hydraulic control device according to the above-described embodiment wherein the pressure is applied to the second accommodating chamber 46 of the flow control valve 37 at a point in the first oil passage K1 between the junction Q and the hydraulic pump 30, the pilot pressure that determines the opening of the flow control valve 37 includes the pressure loss Pz that increases with an increase of the pump flow, with the result that the urging member 45 having a large spring constant K may be employed.

(3) The use of a coil spring with a large spring constant K for the urging member 45 in the flow control valve 37 helps to suppress the irregular fluctuating movement of the valve element 44 in response to the pressure variation in the flow control valve 37, with the result that the flow pulsation caused by the irregular movement of the valve element 44 may be suppressed.

(4) The configuration in which the flow control valve 37 is opened or closed in response to pressure difference simplifies the structure and the control of the hydraulic control device as compared to an electrically-operated device.

(5) The use of the flow control valve 37 that is capable of infinitely varying the flow of hydraulic oil flowing in the second oil passage K2 helps to suppress the chattering and shocking during change of operation.

Second Embodiment

Figure 6A:
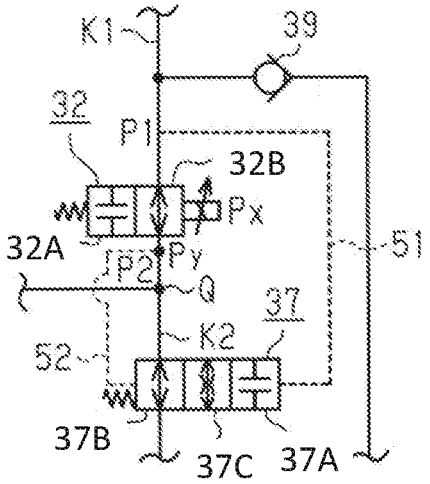
FIG. 6A is a partial circuit diagram of a hydraulic control device according to a second embodiment of the present invention.
Figure 6B:
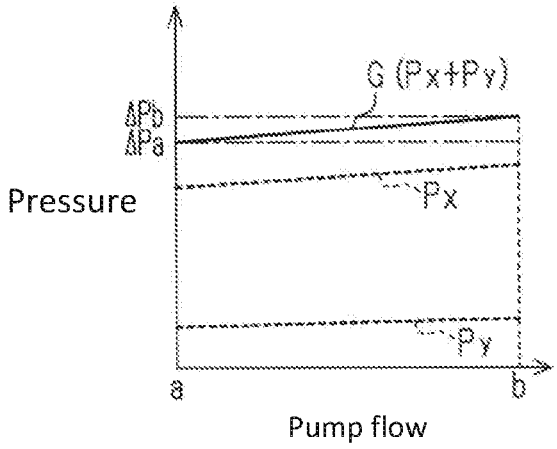
FIG. 6B is a graph showing a relation between the pump flow and the output hydraulic pressure in the hydraulic control device of FIG. 6A.

The following will describe a hydraulic control device of a forklift truck according to a second embodiment with reference to FIGS. 6A and 6B. In the description of the second embodiment, same reference numerals are used for the elements or components that are common in the first and second embodiments, and the description of such elements or components for the second embodiment will be omitted.

As shown in FIG. 6A, the second pilot passage 52 is connected at one end thereof to the first oil passage K1 at a point between the junction Q and the lowering proportional control valve 32 and at the other end thereof to the second accommodating chamber 46 of the flow control valve 37. That is, the second pilot passage 52 allows the pressure of hydraulic oil passing through the lowering proportional control valve 32 to be applied to the second accommodating chamber 46 of the flow control valve 37 through a point between the lowering proportional control valve 32 and the junction Q in the first oil passage K1. Therefore, the pilot pressure that determines the opening of the flow control valve 37 is not influenced by the pressure loss Pz that occurs in the oil passage between the junction Q and the flow control valve 37.

As shown in FIG. 6B, the value of ΔPb−ΔPa is greater than that of the comparative example. The spring constant K of the urging member 45 may be made greater according to Equation (2). The initial deflection amount X0 can be made smaller than that of the comparative example according to Equation (3).

Figure 7:
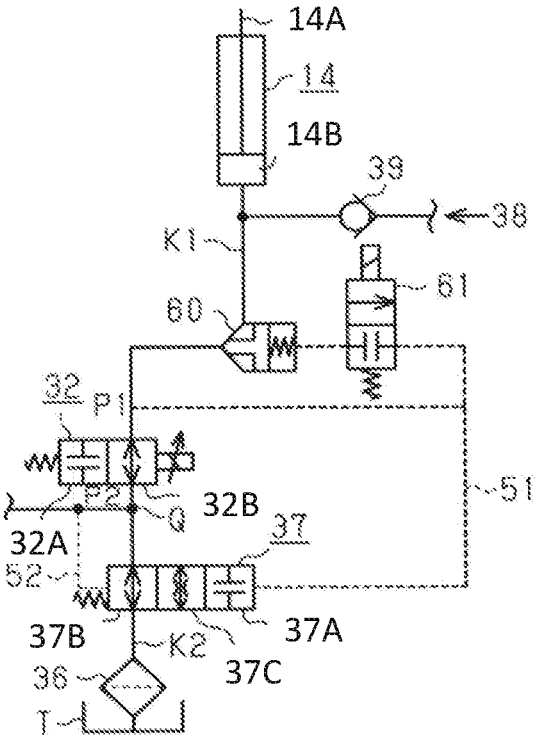
FIG. 7 is a partial circuit diagram of a hydraulic control device of another example.

The above-described embodiments may be practiced variously as exemplified below. As shown in FIG. 7, a poppet valve 60 and an electromagnetic valve 61 may be provided upstream of the lowering proportional control valve 32 (at a position between the lift cylinder 14 and t the lowering proportional control valve 32) to alleviate the shock occurring during switching operation of the valve. Opening the electromagnetic valve 61 while the forks 16 are being lowered causes the poppet valve 60 to open gradually, thereby allowing hydraulic oil to flow to the lowering proportional control valve 32. The flow of the hydraulic oil applied to the hydraulic pump 30 is regulated based on the opening of the lowering proportional control valve 32. In the second embodiment, the poppet valve 60 and the electromagnetic valve 61 may be provided upstream of the lowering proportional control valve 32 (at a position between the lift cylinder 14 and the lowering proportional control valve 32) to alleviate the shock occurring during switching operation of the valve.

In the above embodiments, the operating hydraulic cylinders connected to the hydraulic pump 30 may be provided so as to perform other operations than the lifting of the forks 16 and the forward and backward lifting of the mast assembly 13. For example, an operating hydraulic cylinder for sliding the forks 16 in the lateral direction, tilting or rotating the forks 16 may be used. Alternatively, a handling hydraulic cylinder for operating a device to clamp a load may be used as an operating hydraulic cylinder. A loading member is operated by an operator of a forklift truck when a load is loaded or unloaded.

The lift lever 22 as a raising and lowering instructing member and the tilt lever 23 as an operating instruction member may be replaced by any suitable control such as pushbuttons. The flow control valve 37 and the lowering proportional control valve 32 may be formed into a unit.

What is claimed is:

1. A hydraulic control device of a forklift truck, comprising:

a first hydraulic cylinder that raises and lowers a fork;

a first instructing member that instructs the raising and lowering movement of the fork;

a second hydraulic cylinder that moves an operating member;

a second instructing member that instructs the movement of the operating member;

a hydraulic pump;

an electric motor that is connected to the hydraulic pump;

a first oil passage through which hydraulic oil discharge from the hydraulic cylinder flows into an inlet port of the hydraulic pump during the lowering movement of the fork;

a lowering control valve that is disposed in the first oil passage, wherein the lowering control valve allows flow of hydraulic oil from a bottom chamber of the first hydraulic cylinder into the hydraulic pump during the lowering movement of the fork, and blocks flow of hydraulic oil from the bottom chamber of the first hydraulic cylinder into the hydraulic pump at stop of the fork or during the raising movement of the fork;

a second oil passage that is branched from the first oil passage at a junction between the hydraulic pump and the lowering control valve to flow hydraulic oil discharged front the first hydraulic cylinder to an oil tank connected to the second oil passage;

a flow control valve that is disposed in the second oil passage and controls, based on pressure difference between pressure upstream of and pressure downstream of the lowering control valve, flows of hydraulic oil discharged from the first hydraulic cylinder during the lowering movement of the fork and lowering toward the hydraulic pump and oil tank, the flow control valve including a valve element that determines an opening of the second oil passage, a first accommodating chamber that accommodates the valve element, an urging member that urges the valve element and a second accommodating chamber that accommodates the urging member;

a first pilot passage through which pressure in the first oil passage at a position between the first hydraulic cylinder and the lowering control valve is applied to the first accommodating chamber of the flow control valve as the pressure upstream of the lowering control valve; and a second pilot passage through which pressure in the first oil passage at a position between the lowering control valve and the hydraulic pump is applied to the second accommodating chamber of the flow control valve as the pressure downstream of the lowering control valve, wherein the pressure in the first oil passage at the position between the lowering control valve and the hydraulic pump is pressure downstream of the junction.

2. A hydraulic control device of a forklift truck, comprising:

a first hydraulic cylinder that raises and lowers a fork;

a first instructing member that instructs the raising and lowering movement of the fork;

a second hydraulic cylinder that moves an operating member;

a second instructing member that instructs the movement of the operating member;

a hydraulic pump;

an electric motor that is connected to the hydraulic pump;

a first oil passage through which hydraulic oil discharged from the first hydraulic cylinder flows into an inlet port of the hydraulic pump during the lowering movement of the fork;

a lowering control valve that is disposed in the first oil passage, wherein the lowering control valve allows flow of hydraulic oil from a bottom chamber of the first hydraulic cylinder into the hydraulic pump during the lowering movement of the fork, and blocks flow of hydraulic oil from the bottom chamber of the first hydraulic cylinder into the hydraulic pump at stop of the fork or during the raising movement of the fork;

a second oil passage that is branched from the first oil passage at a junction between the hydraulic pump and the lowering control valve to flow hydraulic oil discharged from the first hydraulic cylinder to an oil tank connected to the second oil passage;

a flow control valve that is disposed in the second oil passage and controls, based on pressure difference between pressure upstream of and pressure downstream of the lowering control valve, flows of hydraulic oil discharged front the first hydraulic cylinder during the lowering movement of the fork and flowing toward the hydraulic pump and the oil tank, the flow control valve including a valve element that determines an opening of the second oil passage, a first accommodating chamber that accommodates the valve element, an urging member that urges the valve element, and a second accommodating chamber that accommodates the urging member;

the first pilot passage through hydraulic which pressure in the first oil passage at a position between the first hydraulic cylinder and the lowering control valve is applied to the first accommodating chamber of the flow control valve as the pressure upstream of the lowering control valve; and a second pilot passage through which pressure in the first oil passage at a position between the lowering control valve and the hydraulic pump is applied to the second accommodating chamber of the flow control valve as the pressure downstream of the lowering control valve, wherein the pressure in the first oil passage at the position between the lowering control valve and the hydraulic pump is pressure upstream of the junction.

3. The hydraulic control device of the forklift truck according to claim 1, wherein the urging member is a coil spring.

4. The hydraulic control device of the forklift truck according to claim 2, wherein the urging member is a coil spring.

* * * * *